US006296720B1

(12) United States Patent
Yamamoto et al.

(10) Patent No.: US 6,296,720 B1
(45) Date of Patent: Oct. 2, 2001

(54) RARE EARTH/IRON/BORON-BASED PERMANENT MAGNET ALLOY COMPOSITION

(75) Inventors: Kenji Yamamoto; Koro Tatami; Takehisa Minowa, all of Fukui-ken (JP)

(73) Assignee: Shin-Etsu Chemical Co., Ltd., Tokyo (JP)

( * ) Notice: Subject to any disclaimer, the term of this patent is extended or adjusted under 35 U.S.C. 154(b) by 0 days.

(21) Appl. No.: 09/456,819

(22) Filed: Dec. 8, 1999

(30) Foreign Application Priority Data

Dec. 15, 1998 (JP) ..... 10-355728
Dec. 15, 1998 (JP) ..... 10-355736

(51) Int. Cl.[7] ..... H01F 1/057
(52) U.S. Cl. ..... 148/302; 75/244; 420/83; 420/121
(58) Field of Search ..... 148/302; 420/83, 420/121; 75/244

(56) References Cited

U.S. PATENT DOCUMENTS 5,162,064 * 11/1992 Kim et al. ..... 148/302
5,589,009 * 12/1996 Kim et al. ..... 148/302
5,968,289 * 10/1999 Sakurada et al. ..... 148/302

FOREIGN PATENT DOCUMENTS 0 106 948 5/1984 (EP) .
0 477 810 4/1992 (EP) .
0 994 483 4/2000 (EP) .

OTHER PUBLICATIONS

Patent Abstracts of Japan, 018 (No. 590)(E–1628), Nov. 10, 1994—Abstract of JP 224018.

* cited by examiner

*Primary Examiner*—John Sheehan
(74) *Attorney, Agent, or Firm*—Wenderoth, Lind & Ponack, L.L.P.

(57) ABSTRACT

Disclosed is a rare earth/iron/boron-based permanent magnet alloy composition capable of giving, by a powder metallurgical process, a permanent magnet having excellent coercive force and residual magnetization as well as good squareness ratio of the hysteresis loop. The magnet alloy composition consists of:

(a) from 28 to 35% by weight of a rare earth element selected from the group consisting of neodymium, praseodymium, dysprosium, terbium and holmium;
(b) from 0.1 to 3.6% by weight of cobalt;
(c) from 0.9 to 1.3% by weight of boron;
(d) from 0.05 to 1.0% by weight of aluminum;
(e) from 0.02 to 0.25% by weight of copper;
(f) from 0.02 to 0.3% by weight of zirconium or chromium;
(g) from 0.03 to 0.1% by weight of carbon;
(h) from 0.1 to 0.8% by weight of oxygen;
(i) from 0.002 to 0.2% by weight of nitrogen; and
(j) the balance to 100% by weight of iron and unavoidable impurity elements.

3 Claims, 4 Drawing Sheets

RARE EARTH/IRON/BORON-BASED PERMANENT MAGNET ALLOY COMPOSITION

BACKGROUND OF THE INVENTION

The present invention relates to a novel rare earth/iron/boron-based permanent magnet alloy composition capable of giving permanent magnets having greatly improved magnetic properties.

As is well known, the demand for rare earth-based permanent magnets is rapidly growing in recent years by virtue of their very excellent magnetic properties enabling a compact design of electric and electronic instruments with a permanent magnet built therein as well as the relative economical merits obtained by using such a high-performance permanent magnet. In order to further increase these advantages, it is now desired to upgrade the magnetic properties of rare earth-based permanent magnets more and more. Among various types of rare earth-based permanents magnets, rare earth/iron/boron-based magnets, referred to as the R/Fe/B-based magnets hereinafter, or, in particular, neodymium/iron/boron-based magnets are highlighted as compared with earlier developed samarium/cobalt-based magnets in respect of lower material costs because of the much greater abundance in nature of neodymium as the principal rare earth element constituting than samarium and saving of expensive cobalt in addition to the much better magnetic properties than samarium/cobalt-based magnets.

A great variety of proposals and attempts have been made heretofore with an object to improve the magnetic properties of the R/Fe/B-based permanent magnets. For example, Japanese Patent Kokai 59-64733 and 59-132104 teach a R/Fe/B-based magnet alloy composition with admixture of titanium, nickel, bismuth, vanadium and others as additive elements with an object to obtain a stabilized coercive force of the magnets. Japanese Patent Kokai 1-219143 proposes addition of 0.02 to 0.5 atomic % of copper to the R/Fe/B-based magnet alloy so as to improve the magnetic properties of the magnets along with an advantage in the productivity of the magnet products due to broadened tolerance for the range of temperatures in which the magnet body is to be subjected to a heat treatment. Further, Japanese Patent Kokai 1-219143 reports an increase in the corrosion resistance of R/Fe/B-based magnets by the addition of 0.2 to 0.5 atomic % of chromium to the magnet alloy.

Starting from the above mentioned copper-admixed R/Fe/B-based magnet alloys, the inventors conducted extensive investigations for further improving the magnetic properties of the magnets by the addition of various kinds of other additive elements. The attempts in this direction, however, were not very fruitful because the improvement in the coercive force of the magnet obtained by the addition of most of other additive elements is accompanied by a decrease in the residual magnetic flux density practically to cancel the improvement in the coercive force.

SUMMARY OF THE INVENTION

The present invention accordingly has an object to provide a novel R/Fe/B-based permanent magnet alloy composition obtained by the addition of unique additive elements to the basic R/Fe/B-based magnet alloy composition to exhibit excellent coercive force and residual magnetic flux density.

Thus, the present invention provides a rare earth/iron/boron-based permanent magnet alloy composition which consists of:

(a) from 28 to 35% by weight of a rare earth element selected from the group consisting of neodymium, praseodymium, dysprosium, terbium and holmium;

(b) from 0.1 to 3.6% by weight of cobalt;

(c) from 0.9 to 1.3% by weight of boron;

(d) from 0.05 to 1.0% by weight of aluminum;

(e) from 0.02 to 0.25% by weight of copper;

(f) from 0.02 to 0.3% by weight of zirconium or chromium;

(g) from 0.03 to 0.1% by weight of carbon;

(h) from 0.1 to 0.8% by weight of oxygen;

(i) from 0.002 to 0.2% by weight of nitrogen; and (j) the balance to 100% by weight of iron and unavoidable impurity elements.

DETAILED DESCRIPTION OF THE PREFERRED EMBODIMENTS

Figure 1:
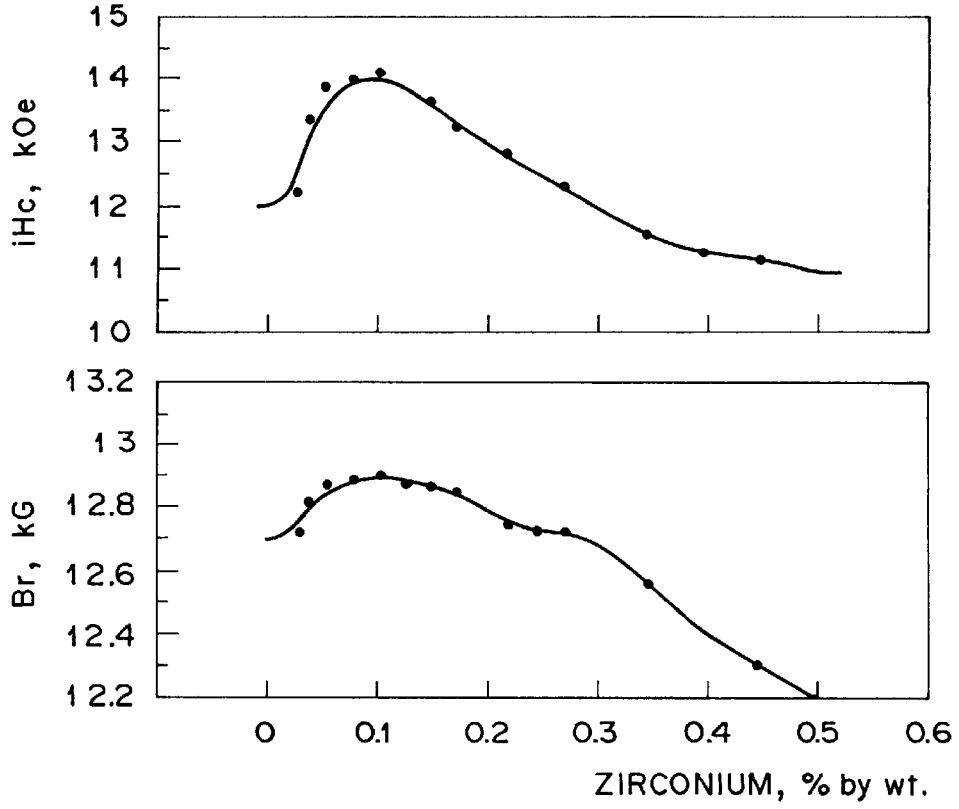
FIG. 1 is a graph showing the coercive force (upper) and residual magnetic flux density (lower) of the magnets prepared in Example 1 as a function of the content of zirconium in the magnet alloy composition.

The R/Fe/B-based magnet alloy composition of the present invention having the above specified chemical composition gives a high-performance permanent magnet exhibiting outstandingly improved coercive force and residual magnetic flux density along with excellent squareness ratio of the hysteresis loop.

The rare earth element as the component (a), which is one of the principal ingredient elements in the inventive R/Fe/B-based magnet alloy composition, is selected from the group consisting of neodymium, praseodymium, dysprosium, terbium and holmium. These rare earth elements can be contained in the inventive magnet alloy composition either singly or as a combination of two kinds or more. The content or weight fraction of the rare earth element or elements as the component (a) in the alloy composition is in the range from 28 to 35% by weight. When the content of the component (a) is too low, the desired improvement in the coercive force of the magnet can hardly be accomplished while, when the content thereof is too high, a great decrease is resulted in the residual magnetic flux density of the magnet.

Cobalt as the component (b) is, so to say, a substitute element for iron since it is known that substitution of cobalt for a part of iron has an effect of increasing the Curie point of the magnet. The content of cobalt is in the range from 0.1 to 3.6% by weight. When the content of cobalt is too low, the desired improvement in the Curie point of the magnet can hardly be obtained while no further improvement in the Curie point can be obtained by increasing the content of cobalt to exceed the upper limit rather with an economical disadvantage due to relative expensiveness of cobalt.

The content of boron as the component (c), which is also one of the principal ingredients in the R/Fe/B-based magnet, is in the range from 0.9 to 1.3% by weight. When the content of boron is too low, a great decrease is caused in the coercive force of the magnet while, when the content thereof is too high, the residual magnetic flux density is greatly decreased.

Aluminum as the component (d) in the inventive alloy composition has an effect of increasing the coercive force of the magnet. Since aluminum is a relatively inexpensive metallic material, such an improvement can be obtained without substantial increase in the material costs. The content of aluminum in the alloy composition is in the range from 0.05 to 1.0% by weight. When the content thereof is too low, the above mentioned advantageous effect on the coercive force of the magnet can hardly be obtained as a matter of course while, when the content thereof is too high, a great decrease is caused in the residual magnetic flux density.

Copper as the component (e) in the inventive permanent magnet alloy composition has an effect, as is mentioned before, to impart remarkably improved magnetic properties to the R/Fe/B-based permanent magnet prepared from the alloy composition. The content of copper in the alloy composition is in the range from 0.02 to 0.25% by weight. When the content of copper is too low, the desired advantageous effect thereby on the coercive force of the magnet can hardly be exhibited as a matter of course while, when the content of copper is too high, a great decrease is caused in the residual magnetic flux density of the magnet.

The component (f) in the inventive magnet alloy composition is either zirconium or chromium although these two elements can be contained in combination. Addition of these elements to the inventive magnet alloy composition as combined with copper is very effective to impart a greatly improved coercive force to the magnet prepared from the alloy. The content of zirconium and/or chromium in the inventive magnet alloy composition is in the range from 0.02 to 0.3% by weight. It is preferable, however, that the content of the component (f) is at least 0.03% when the component (f) is zirconium and should not exceed 0.25% by weight when the component (f) is chromium. When the content of the component (f) is too low, the desired improvement on the coercive force of the magnet can hardly be obtained as a matter of course while, when the amount thereof is too high, a great decrease is caused in the residual magnetic flux density of the magnet.

In addition to the above described various elements, it is essential that the contents of carbon, oxygen and nitrogen are controlled each within a specified range in order to ensure good squareness ratio of the hysteresis loop of the magnet prepared from the magnet alloy composition.

Thus, the content of carbon as the component (g) is controlled in the range from 0.03 to 0.1% by weight. When the content of carbon is too low, the magnet alloy is liable to cause oversintering in the powder metallurgical preparation of the magnet in addition to a decrease in the squareness ratio. When the content of carbon is too high, both of the sintering behavior of the alloy and squareness ratio of the magnet are adversely affected.

The content of oxygen as the component (h) is controlled in the range from 0.1 to 0.8% by weight. The adverse influences caused when the content of oxygen is too low or too high are similar to the influences caused by a too low or too high content of carbon.

The content of nitrogen as the component (i) is controlled in the range from 0.002 to 0.02% by weight. The adverse influences caused when the content of nitrogen is too low or too high are similar to the influences caused by a too low or too high content of carbon.

While description is given above on the various ingredient elements (a) to (i) and contents thereof in the inventive magnet alloy composition, the major constituent element in the inventive R/Fe/B-based magnet is iron as the component (j). The content of the component (j), which includes, besides iron, a variety of impurity elements unavoidably brought into the alloy composition each in a trace but uncontrollable amount as contained in the starting materials and in the course of alloy preparation, is the balance to 100% by weight after specifying the respective contents of the components (a) to (i).

The R/Fe/B-based permanent magnet alloy composition of the invention can be prepared according to the procedure for the preparation of neodymium-based magnet alloy compositions in general. Namely, each a specified amount of the respective constituent elements are taken and melted together by high-frequency induction heating under an atmosphere of an inert gas such as argon followed by casting of the alloy melt into a mold to give an ingot of the alloy. It is optional that some of the additive elements such as boron, copper and zirconium or chromium are alloyed beforehand with, for example, iron or aluminum.

The unavoidable impurity elements include rare earth elements other than the component (a), nickel, manganese, silicon, calcium, magnesium, sulfur and phosphorus. These impurity elements have no particular adverse influences on the properties of the inventive magnet alloy composition provided that the total amount thereof does not exceed, for example, about 0.2% by weight.

The R/Fe/B-based magnet alloy composition of the invention can be processed into a permanent magnet according to a conventional powder metallurgical method. Thus, the alloy is first crushed by using a jaw crusher or Brown mill into coarse particles which are then pulverized by a wet-process grinding method in an organic solvent by using a ball mill or attrition machine or by a dry-process grinding method using a jet mill with nitrogen as the jet gas into fine particles having an average particle diameter of 1 to 10 $\mu$m. The fine magnet alloy powder is shaped into a powder compact by compression molding in a magnetic field of about 10 kOe to align the particles relative to their easy magnetization axes under a compressive force of about 1 to 2 tons/cm$^2$. The powder compact as a green body is subjected to a sintering heat treatment in vacuum or in an atmosphere of an inert gas at a temperature of 1000 to 1200° C. taking 1 to 2 hours followed by an aging treatment at a temperature lower than the sintering temperature, e.g., 600° C., to give a permanent magnet block.

The content of oxygen in the magnets can be controlled either by adjusting the oxygen concentration in the atmosphere during the fine pulverization treatment of the magnetic alloy ingot or by conducting degassing in the sintering heat treatment under a flow of a gas containing a trace volume of oxygen. The content of nitrogen in the magnets can be controlled by using starting materials for the magnet alloy containing a controlled amount of nitrogen or by conducting degassing in the sintering heat treatment under a flow of a gas containing a controlled trace volume of nitrogen. The content of carbon in the magnets can be controlled by preparing the magnetic alloy ingot from starting base materials of different carbon contents which may be high or low.

Final product of R/Fe/B-based permanent magnets can be obtained from this sintered magnet block by mechanical working into magnet pieces and surface treatment thereof.

In the following, the present invention is illustrated in more detail by way of examples, which, however, never limit the scope of the invention in any way.

EXAMPLE 1

The base materials taken in the preparation of magnet alloy compositions included neodymium metal, dysprosium metal, electrolytic iron, cobalt metal, ferroboron, aluminum metal, copper metal and ferrozirconium. A blend of these base materials were taken by weighing in such a proportion as to give 30% by weight of neodymium, 1% by weight of dysprosium, 3% by weight of cobalt, 1% by weight of boron, 0.5% by weight of aluminum, 0.2% by weight of copper and a varied amount up to 0.5% by weight of zirconium, the balance being iron, and they were heated and melted together in an alumina crucible by high-frequency induction heating under an atmosphere of argon followed by casting of the melt into a water-cooled copper mold to give magnet alloy ingots having chemical compositions varied relative to the contents of zirconium and hence iron as the balance to 100%.

Each of the alloy ingots was crushed in a Brown mill into coarse particles which were pulverized in a jet mill with nitrogen as the jet gas into fine particles having an average particle diameter of 3 $\mu$m followed by admixture of 0.07% by weight of stearic acid as a lubricant under an atmosphere of nitrogen using a V-mixer. This fine magnet alloy powder was shaped by compression molding in a metal mold under a compressive force of 1.2 tons/cm$^2$ with application of a magnetic field of 10 kOe in a direction perpendicular to the direction of compression for molding to give a powder compact, which was subjected to a sintering heat treatment at 1060° C. for 2 hours in an atmosphere of argon followed by cooling and further to an aging heat treatment at 600° C. for 1 hour also in an atmosphere of argon to give R/Fe/B-based permanent magnets containing zirconium in varied contents. Transfer of the material under processing from pulverization of the alloy ingot to sintering was undertaken always under an atmosphere of nitrogen in order to keep the oxygen content in the magnets as low as possible.

These magnets were subjected to chemical analysis to find that the contents of carbon, oxygen and nitrogen were in the ranges from 0.085 to 0.095% by weight, from 0.15 to 0.25% by weight and from 0.01 to 0.015% by weight, respectively.

The thus prepared permanent magnets were subjected to the measurement of the coercive force iHc and residual magnetic flux density Br and the results are shown in the upper and lower curves, respectively, of FIG. 1 each as a function of the content of zirconium. As is understood from these graphs, the coercive force of the magnets could be increased by the addition of zirconium in an amount not exceeding 0.3% by weight without being accompanied by a decrease in the residual magnetic flux density. For example, addition of 0.1% by weight of zirconium had an effect of increasing the coercive force by 2 kOe and the residual magnetic flux density by 0.2 kG. When the amount of zirconium addition exceeded 0.3% by weight, on the other hand, a decrease was noted in each of the coercive force and the residual magnetic flux density.

EXAMPLE 2

The procedures for the preparation of magnetic alloy compositions and processing of the same into permanent magnets were substantially the same as in Example 1 except that pulverization of the magnetic alloy ingot into a fine powder and compression molding of the powder into a powder compact were conducted in an atmosphere of varied oxygen concentration. The thus prepared magnets consisted of 30.5% by weight of neodymium, 0.5% by weight of terbium, 1% by weight of cobalt, 1.1% by weight of boron, 0.8% by weight of aluminum, 0.1% by weight of copper, 0.1% by weight of zirconium, 0.06 to 1.13% by weight of oxygen, 0.035 to 0.045% by weight of carbon and 0.005 to 0.010% by weight of nitrogen, the balance being iron and trace amounts of other impurity elements.

Figure 2:
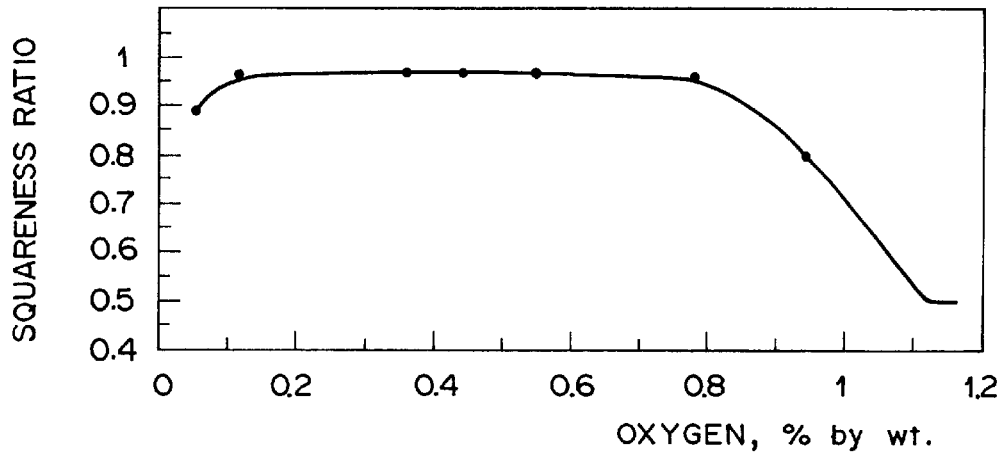
FIG. 2 is a graph showing the squareness ratio of the magnets prepared in Example 2 as a function of the content of oxygen in the magnetic alloy composition.

The thus prepared permanent magnets were subjected to the measurements of the magnetic properties, from which the values of squareness ratio of hysteresis loops, i.e. $(BH)max/(Br/2)^2$, were calculated and shown in FIG. 2 as a function of the content of oxygen.

As is understood from the results shown in FIG. 2, the squareness ratio was decreased when the content of oxygen was lower than 0.1% by weight presumably due to oversintering while the squareness ratio was also decreased when the content of oxygen exceeded 0.8% by weight due to the poor sintering behavior of the magnet alloy powders.

EXAMPLE 3

The procedures for the preparation of magnetic alloy compositions and processing of the same into permanent magnets were substantially the same as in Example 1. The thus prepared magnets consisted of 30.5% by weight of neodymium, 1.5% by weight of praseodymium, 2% by weight of cobalt, 1.1% by weight of boron, 0.7% by weight of aluminum, 0.1% by weight of copper, 0.1% by weight of zirconium, 0.01 to 0.12% by weight of carbon, 0.65 to 0.75% by weight of oxygen and 0.015 to 0.020% by weight of nitrogen, the balance being iron and trace amounts of other impurity elements.

Figure 3:
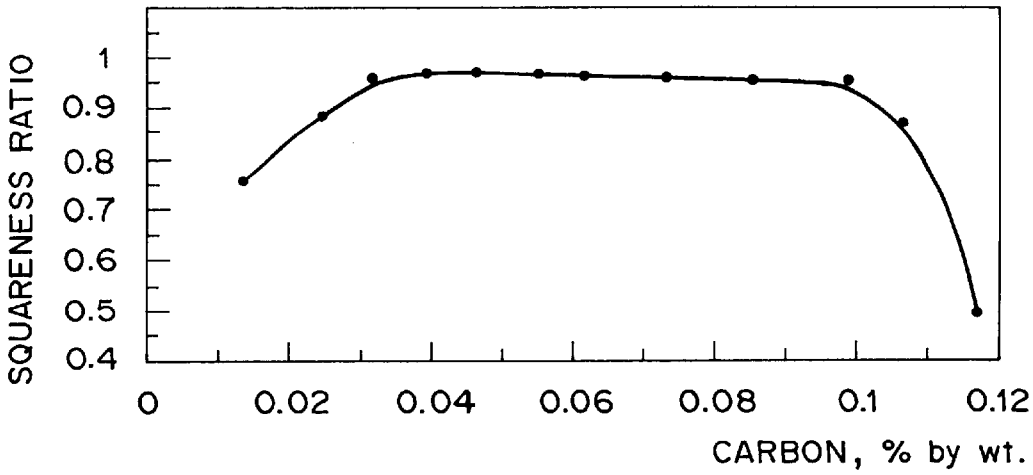
FIG. 3 is a graph showing the squareness ratio of the magnets prepared in Example 3 as a function of the content of carbon in the magnetic alloy composition.

The thus prepared permanent magnets were subjected to the measurements of the magnetic properties, from which the values of squareness ratio of hysteresis loops, i.e. $(BH)max/(Br/2)^2$, were calculated and shown in FIG. 3 as a function of the content of carbon.

As is understood from the results shown in FIG. 3, the squareness ratio was decreased when the content of carbon was lower than 0.03% by weight presumably due to oversintering while the squareness ratio was also decreased when the content of carbon exceeded 0.1% by weight due to the poor sintering behavior of the magnet alloy powders.

EXAMPLE 4

Permanent magnets were prepared from an alloy of a composition consisting of 30.5% by weight of neodymium, 1.0% by weight of dysprosium, 2% by weight of cobalt, 1.1% by weight of boron, 0.6% by weight of aluminum, 0.1% by weight of copper and 0.1% by weight of zirconium, the balance being iron. The magnets contained 0.001 to 0.03% by weight of nitrogen. The contents of carbon and oxygen in the magnets were from 0.055 to 0.065% by weight and from 0.35 to 0.45% by weight, respectively. The content of nitrogen in the magnets was controlled by preparing the magnet alloy from starting base materials containing varied amounts of nitrogen.

Figure 4:
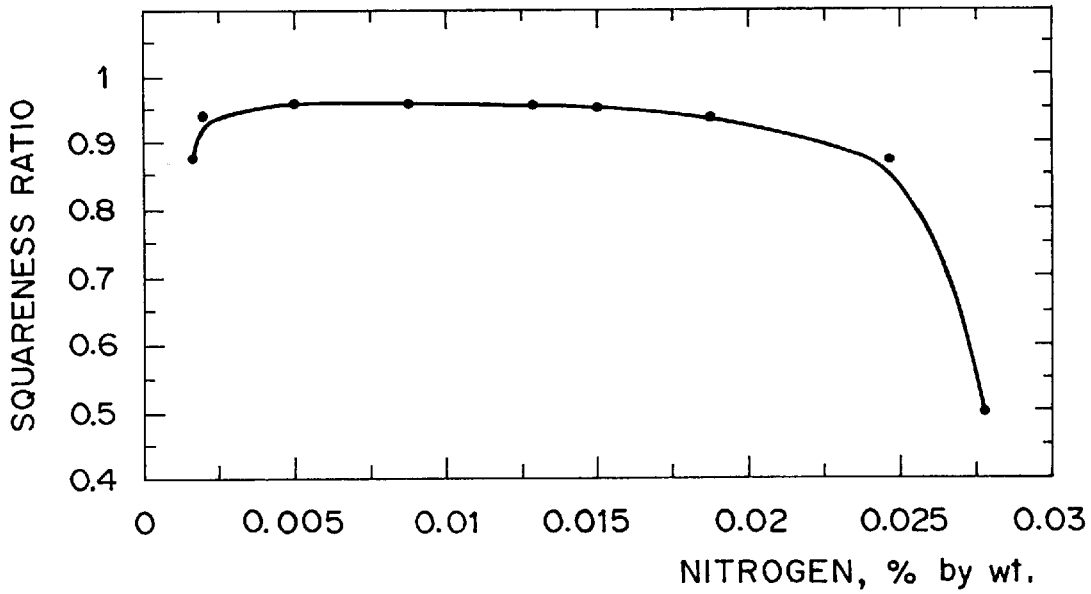
FIG. 4 is a graph showing the squareness ratio of the magnets prepared in Example 4 as a function of the content of nitrogen in the magnetic alloy composition.

The squareness ratios of the magnets are graphically shown in FIG. 4 as a function of the nitrogen content. This graph indicates that the squareness ratio is decreased with a nitrogen content lower than 0.002% by weight presumably due to oversintering and also decreases when the nitrogen content exceeds 0.02% by weight due to poor sintering behavior of the magnet alloy powders.

EXAMPLE 5

The procedures for the preparation of magnetic alloy compositions and processing of the same into permanent magnets were substantially the same as in Example 1 except that the alloy compositions consisted of 30% by weight of neodymium, 1% by weight of dysprosium, 3% by weight of cobalt, 1% by weight of boron, 0.5% by weight of aluminum, 0.2% by weight of copper and a varied amount up to 0.5% by weight of chromium introduced in the form of a ferrochromium, the balance being iron, carbon, oxygen, nitrogen and trace amounts of other impurity elements.

The contents of carbon, oxygen and nitrogen in the magnet alloys were in the ranges from 0.035 to 0.045% by weight, from 0.65 to 0.75% by weight and from 0.005 to 0.01% by weight, respectively.

Figure 5:
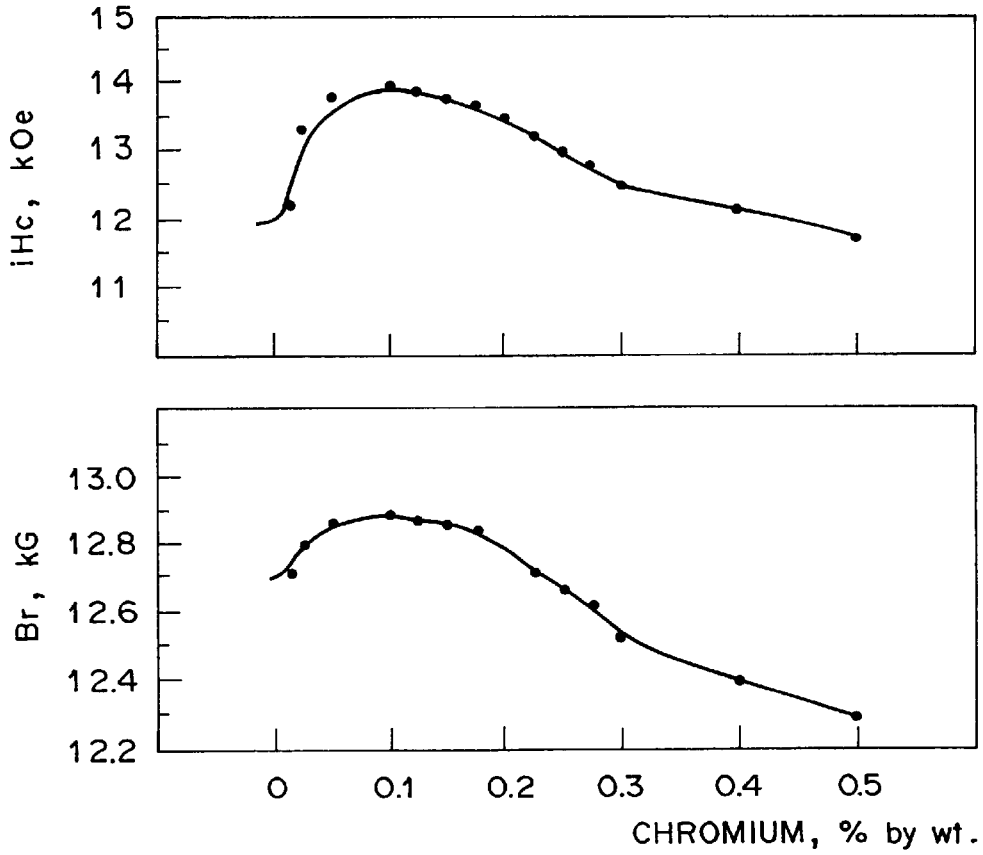
FIG. 5 is a graph showing the coercive force (upper) and residual magnetic flux density (lower) of the magnets prepared in Example 5 as a function of the content of chromium in the magnet alloy composition.

The thus prepared permanent magnets were subjected to the measurement of the coercive force iHc and residual magnetic flux density Br and the results are shown in the upper and lower curves, respectively, of FIG. 5 each as a function of the content of chromium.

As is understood from these graphs, the coercive force of the magnets could be increased by the addition of chromium in an amount not exceeding 0.25% by weight without being accompanied by a decreased in the residual magnetic flux density. For example, addition of 0.1% by weight of chromium had an effect of increasing the coercive force by 2 kOe and the residual magnetic flux density by 0.2 kG. Addition of chromium in an amount exceeding 0.25% by weight was also effective in increasing the coercive force though being accompanied by a substantial decrease in the residual magnetic flux density.

EXAMPLE 6

The procedures for the preparation of magnetic alloy compositions and processing of the same into permanent magnets were substantially the same as in Example 5 except that pulverization of the Alloy ingot into a fine powder and compression molding of the powder into a powder compact were conducted in an atmosphere of a varied oxygen concentration. The thus prepared magnets consisted of 30.5% by weight of neodymium, 0.5% by weight of terbium, 1% by weight of cobalt, 1.1% by weight of boron, 0.8% by weight of aluminum, 0.1% by weight of copper, 0.1% by weight of chromium, 0.085 to 0.0955% by weight of carbon, 0.015 to 0.020% by weight of nitrogen and 0.08 to 1.10% by weight of oxygen, the balance being iron and trace amounts of other impurity elements.

Figure 6:
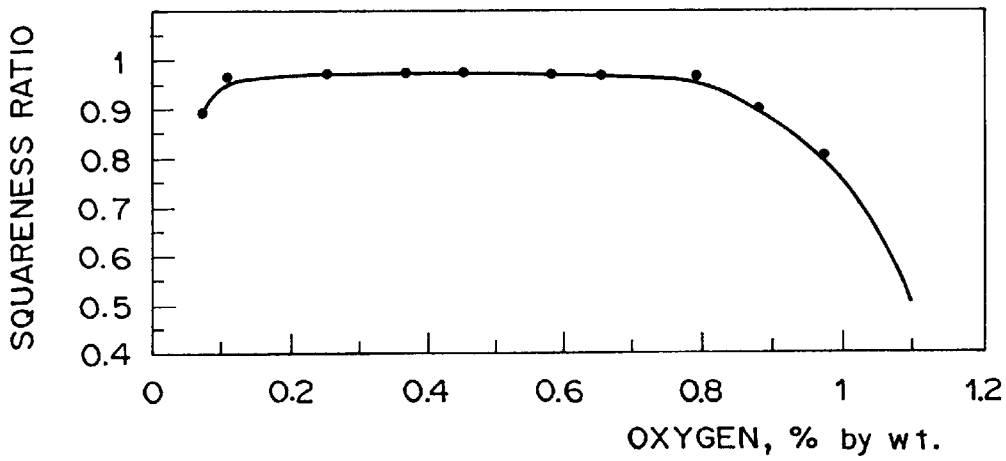
FIG. 6 is a graph showing the squareness ratio of the magnets prepared in Example 6 as a function of the content of oxygen in the magnetic alloy composition.

The thus prepared permanent magnets were subjected to the measurements of the magnetic properties, from which the values of squareness ratio of hysteresis loops, i.e. (BH) max/$(Br/2)^2$, were calculated and shown in FIG. 6 as a function of the content of oxygen.

As is understood from the results shown in FIG. 6, the squareness ratio was decreased when the content of oxygen was lower than 0.1% by weight presumably due to oversintering while the squareness ratio was also decreased when the content of oxygen exceeded 0.8% by weight due to the poor sintering behavior of the magnet alloy powders.

EXAMPLE 7

The procedures for the preparation of magnetic alloy compositions and processing of the same into permanent magnets were substantially the same as in Example 5. The thus prepared magnets consisted of 30.5% by weight of neodymium, 1.5% by weight of praseodymium, 2% by weight of cobalt, 1.1% by weight of boron, 0.7% by weight of aluminum, 0.1% by weight of copper, 0.1% by weight of chromium, 0.15 to 0.25% by weight of oxygen, 0.01 to 0.015% by weight of nitrogen and 0.015 to 0.12% by weight of carbon, the balance being iron and trace amounts of other impurity elements.

Figure 7:
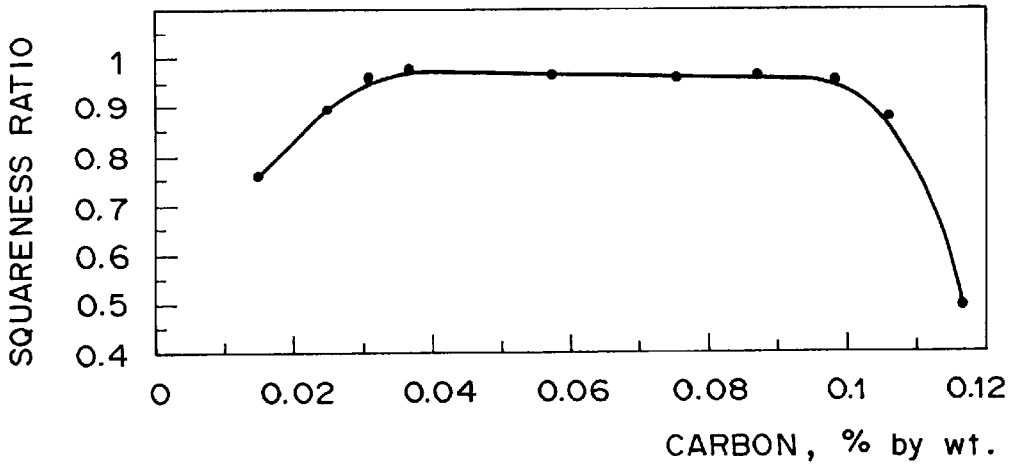
FIG. 7 is a graph showing the squareness ratio of the magnets prepared in Example 7 as a function of the content of carbon in the magnetic alloy composition.

The thus prepared permanent magnets were subjected to the measurements of the magnetic properties, from which the values of squareness ratio of hysteresis loops, i.e. (BH) max/$(Br/2)^2$, were calculated and shown in FIG. 7 as a function of the content of carbon.

As is understood from the results shown in FIG. 7, the squareness ratio was decreased when the content of carbon was lower than 0.03% by weight presumably due to oversintering while the squareness ratio was also decreased when the content of carbon exceeded 0.1% by weight due to the poor sintering behavior of the magnet alloy powders.

EXAMPLE 8

Permanent magnets were prepared in the same manner as in Example 5 from an alloy of a composition consisting of 30.5% by weight of neodymium, 1.0% by weight of dysprosium, 2% by weight of cobalt, 1.1% by weight of boron, 0.6% by weight of aluminum, 0.1% by weight of copper and 0.1% by weight of chromium, the balance being iron and trace amounts of other impurity elements. The magnets contained 0.001 to 0.03% by weight of nitrogen. The contents of carbon and oxygen in the magnets were from 0.055 to 0.065% by weight and from 0.35 to 0.45% by weight, respectively. The content of nitrogen in the magnets was controlled by preparing the magnet alloy from starting base materials containing varied amounts of nitrogen.

Figure 8:
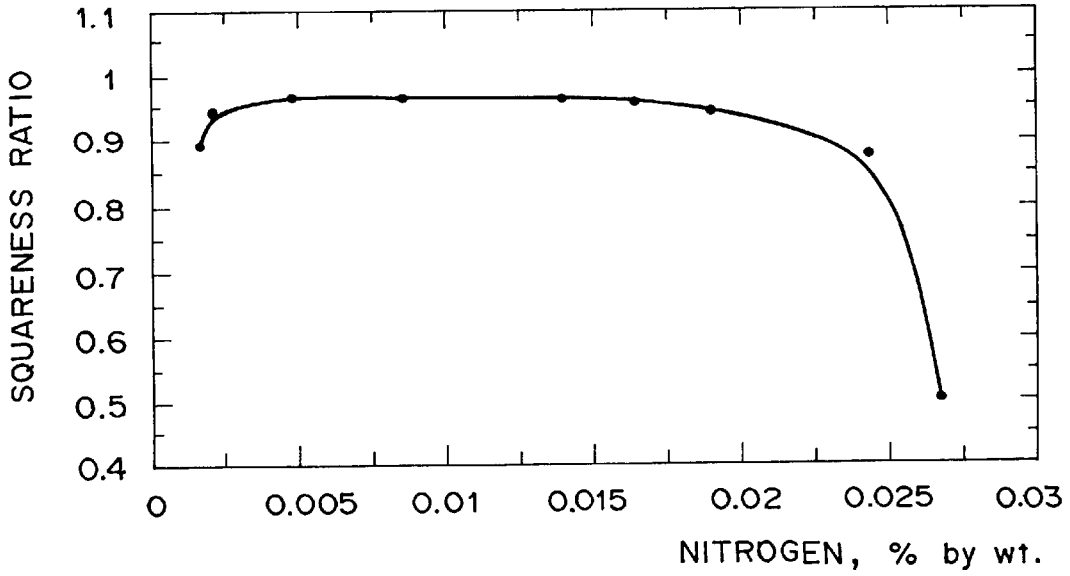
FIG. 8 is a graph showing the squareness ratio of the magnets prepared in Example 8 as a function of the content of nitrogen in the magnetic alloy composition.

The squareness ratios of the magnets are graphically shown in FIG. 8 as a function of the nitrogen content. This graph indicates that the squareness ratio is decreased with a nitrogen content lower than 0.002% by weight presumably due to oversintering and also decreases when the nitrogen content exceeds 0.02% by weight due to poor sintering behavior of the magnet alloy powders.

What is claimed is:

1. A sintered, magnetically anisotropic permanent magnet of a rare earth/iron/boron-based permanent magnet alloy composition which consists of:

(a) from 28 to 35% by weight of a rare earth element selected from the group consisting of neodymium, praseodymium, dysprosium, terbium and holmium;

(b) from 0.1 to 3.6% by weight of cobalt;

(c) from 0.9 to 1.3% by weight of boron;

(d) from 0.05 to 1.0% by weight of aluminum;

(e) from 0.02 to 0.25% by weight of copper;

(f) from 0.02 to 0.3% by weight of zirconium or chromium;

(g) from 0.03 to 0.1% by weight of carbon;

(h) from 0.1 to 0.8% by weight of oxygen;

(i) from 0.002 to 0.2% by weight of nitrogen; and (j) the balance to 100% by weight of iron and unavoidable impurity elements.

2. The sintered, magnetically anisotropic permanent magnet of the rare earth/iron/boron-based permanent magnet alloy composition as claimed in claim 1 in which the component (f) is zirconium and the amount thereof is in the range from 0.03 to 0.3% by weight.

3. The sintered, magnetically anisotropic permanent magnet of the rare earth/iron/boron-based permanent magnet alloy composition as claimed in claim 1 in which the component (f) is chromium and the amount thereof is in the range from 0.02 to 0.25% by weight.

* * * * *